US008894312B2

(12) United States Patent
Toh et al.

(10) Patent No.: US 8,894,312 B2
(45) Date of Patent: Nov. 25, 2014

(54) CONSUMER PACKAGING

(75) Inventors: Kiat-Cheong Toh, Forest Hills, NY (US); Jonas Damon, New York, NY (US); Daniel Antonio Pacis-Sanchez, Brooklyn, NY (US); Allison Stacey Conner, Brooklyn, NY (US)

(73) Assignee: Colgate-Palmolive Company, New York, NY (US)

( * ) Notice: Subject to any disclaimer, the term of this patent is extended or adjusted under 35 U.S.C. 154(b) by 616 days.

(21) Appl. No.: 13/130,403

(22) PCT Filed: Dec. 21, 2010

(86) PCT No.: PCT/US2010/061607

§ 371 (c)(1),
(2), (4) Date: May 20, 2011

(87) PCT Pub. No.: WO2012/087299

PCT Pub. Date: Jun. 28, 2012

(65) Prior Publication Data

US 2012/0155947 A1 Jun. 21, 2012

(51) Int. Cl.
*B43K 7/00* (2006.01)
*A45D 34/04* (2006.01)

(52) U.S. Cl.
CPC ..... *A45D 34/041* (2013.01)
USPC ..... 401/209; 401/213

(58) Field of Classification Search
USPC ..... 401/209, 213, 215, 216, 218, 219; D9/726–729
See application file for complete search history.

(56) References Cited

U.S. PATENT DOCUMENTS

| | | | | |
|---|---|---|---|---|
| D112,696 | S | 12/1938 | Havekost | |
| D169,642 | S | 5/1953 | St. Clair | |
| D172,852 | S | 8/1954 | Van Koert | |
| D176,590 | S | 1/1956 | Breen | |
| 2,923,957 | A * | 2/1960 | Gentile | 401/213 |
| 2,968,826 | A * | 1/1961 | Leshin | 401/214 |
| D195,738 | S | 7/1963 | Grasty | |
| D216,294 | S | 12/1969 | Rias | |
| D216,460 | S | 1/1970 | Gibson | |

(Continued)

FOREIGN PATENT DOCUMENTS

| | | |
|---|---|---|
| CD | 000573431-0005 | 10/2006 |
| CD | 000573431-0006 | 10/2006 |

(Continued)

OTHER PUBLICATIONS

International Search Report and Written Opinion in International Application No. PCT/US10/061607, mailed Sep. 9, 2011.

*Primary Examiner* — John K Fristoe, Jr.
*Assistant Examiner* — Jennifer C Chiang
(74) *Attorney, Agent, or Firm* — Judy W. Chung

(57) ABSTRACT

A package for a composition, the package comprising a container having a base comprising a base face for standing the package on a planar surface, and a cap removably connected to and covering a dispensing end of the container opposite to the base. The cap has an end face which is inclined to the base face, and the container and cap are shaped to permit the package, independent of the amount of the consumer composition contained within the container, selectively to be stood on the base face in an upright orientation on the planar surface or on the end face in an inverted orientation on the planar surface.

28 Claims, 5 Drawing Sheets

(56) References Cited

U.S. PATENT DOCUMENTS

| | | | | |
|---|---|---|---|---|
| D234,940 | S | 4/1975 | Mezquita | |
| D248,214 | S * | 6/1978 | DiNuccio | D9/726 |
| D259,094 | S | 5/1981 | Weckman | |
| D288,528 | S | 3/1987 | Parad | |
| D307,714 | S | 5/1990 | Rosenberg | |
| D323,110 | S | 1/1992 | Simms et al. | |
| D325,520 | S | 4/1992 | Biesecker | |
| 5,178,308 | A | 1/1993 | Endre | |
| D343,117 | S | 1/1994 | Mansau | |
| D360,583 | S | 7/1995 | Paping | |
| D391,457 | S | 3/1998 | Mason, III | |
| D392,890 | S | 3/1998 | Zaksenberg | |
| D399,005 | S | 9/1998 | Chan et al. | |
| D423,360 | S | 4/2000 | Hirato et al. | |
| D429,161 | S | 8/2000 | LePage | |
| D432,918 | S | 10/2000 | Aftoora | |
| 6,132,126 | A | 10/2000 | Sheffler et al. | |
| 6,305,562 | B1 | 10/2001 | Chan et al. | |
| 6,328,496 | B1 * | 12/2001 | Hill et al. | 401/209 |
| 6,357,945 | B1 * | 3/2002 | Losier et al. | 401/175 |
| D475,927 | S | 6/2003 | Maddy | |
| D481,636 | S | 11/2003 | Camacho | |
| D498,676 | S | 11/2004 | Crawford | |
| 6,814,520 | B1 * | 11/2004 | Delli Venneri et al. | 401/213 |
| D512,637 | S | 12/2005 | De Monclin | |
| D519,376 | S | 4/2006 | Ames | |
| D531,905 | S | 11/2006 | Day | |
| D532,308 | S | 11/2006 | Davies et al. | |
| D538,483 | S | 3/2007 | Bakic | |
| D538,668 | S | 3/2007 | Campbell et al. | |
| D543,851 | S | 6/2007 | Franic | |
| D558,049 | S | 12/2007 | Eaton et al. | |
| D560,017 | S | 1/2008 | Morris et al. | |
| D588,459 | S | 3/2009 | Davis et al. | |
| D588,460 | S | 3/2009 | Davis et al. | |
| D592,527 | S | 5/2009 | Serio et al. | |
| D592,957 | S | 5/2009 | Davis et al. | |
| D601,899 | S | 10/2009 | Davis et al. | |
| 8,016,162 | B2 * | 9/2011 | Cleary et al. | 222/215 |
| 2002/0012565 | A1 | 1/2002 | Sirna et al. | |
| 2008/0304900 | A1 * | 12/2008 | Chunga Chavez | 401/270 |
| 2009/0123219 | A1 * | 5/2009 | Baltzell | 401/209 |
| 2010/0226707 | A1 | 9/2010 | Maelstaf et al. | |

FOREIGN PATENT DOCUMENTS

| | | | |
|---|---|---|---|
| CD | 000573431-0009 | | 10/2006 |
| DE | 8420113 | | 4/1985 |
| DE | 3402614 | A1 * | 8/1985 |
| FR | 2946508 | | 12/2010 |
| RU | 48287 | | 10/2005 |
| RU | 49385 | | 11/2005 |
| RU | 49531 | | 11/2005 |
| RU | 49917 | | 12/2005 |
| RU | 57852 | | 10/2006 |

* cited by examiner

CONSUMER PACKAGING

CROSS-REFERENCE TO RELATED APPLICATIONS

The present application is a U.S. national stage application under 35 U.S.C. § 371 of International Application No. PCT/US2010/061607, filed Dec. 21, 2010, the entirety of which is incorporated herein by reference.

FIELD OF THE INVENTION

The present invention relates to a package for a consumer composition, for example an antiperspirant composition, a deodorant composition, a soap composition, a detergent composition, a fabric softener composition or other compositions for consumer use.

BACKGROUND OF THE INVENTION

It is well known to provide a variety of different roll-ball dispensers for consumer compositions such as antiperspirant compositions, deodorant compositions and/or detergent compositions. A bottle contains the liquid composition and a roll-ball is held captive at a head at the top of the bottle, the roll-ball being covered by a removable cap when the product is not in use. It is possible to invert the bottle prior to use in order to apply the liquid composition to an inwardly directed surface of the ball prior to rotating the ball against the skin to deposit the liquid composition on a desired area of the skin. Such packages are generally intended to have an aesthetic appeal as well as provide an ergonomic design for ease of application of the consumer composition to the either the body of the user or another surface.

It is known to provide a number of different package designs which purport to meet these design criteria of aesthetic appeal combined with an ergonomic design. For example, it is known to provide a linear or angled relationship between the body of the bottle and the head of the bottle to provide convenient application to particular parts of the body, for example the underarm area, and concave or convex surfaces of the bottle for ease of manual handling, in particular secure gripping. US-A-2002/012565 discloses such an angled head.

Nevertheless, there is a need in the art for a package for a consumer composition which provides improved manual control by the user and easier application to only desired areas.

There is also a need in the art for a package for a consumer composition which is easier to use, in particular to provide an initial wetting of the ball by the liquid composition.

There is furthermore a need in the art for a package for a consumer composition which exhibits improved aesthetic appeal.

BRIEF SUMMARY OF THE INVENTION

In one embodiment, the present invention provides a package for a consumer composition, the package comprising a container containing a composition, the container having a base comprising a base face for standing the package on a planar surface, and a cap removably connected to and covering a dispensing end of the container opposite to the base, wherein the cap has an end face which is inclined to the base face, and the container and cap are shaped to permit the package, independent of the amount of the composition contained within the container, selectively to be stood on the base face in an upright orientation on the planar surface or on the end face in an inverted orientation on the planar surface.

Optionally, in some embodiments the package is a roll-ball dispenser for a liquid composition and the dispensing head includes a roll-ball captive in the head.

Optionally, in some embodiments the composition is an antiperspirant composition and/or a deodorant composition.

Optionally, in some embodiments in an upright orientation the centre of gravity of the package lies within the area of the base face.

Optionally, in some embodiments in an inverted orientation the centre of gravity of the package lies within the area of the end face.

Optionally, in some embodiments the end face and the base face are mutually inclined at an acute angle of from 5° to 40°, further optionally from 15° to 35°.

Optionally, in some embodiments the container includes at least one window to permit a user to see the consumer composition within the container.

Optionally, in some embodiments the at least one window is located in the vicinity of the base face.

Optionally, in some embodiments the at least one window is located in the vicinity of the dispensing end.

Optionally, in some embodiments the at least one window comprises a first window located in the vicinity of the base face and a second window located in the vicinity of the dispensing end.

Optionally, in some embodiments the at least one window comprises an elongate window extending longitudinally from the vicinity of the base face to the vicinity of the dispensing end.

Optionally, in some embodiments wherein the container has a body portion above the base, a neck portion above the body portion, and a dispensing head above the neck portion, the cap covering the dispensing head, the body portion being aligned along a first axis and the neck portion being aligned along a second axis which is inclined to the first axis so that the dispensing head is directed upwardly and laterally towards a front of the container, the neck portion and the dispensing head having an exterior periphery which is not equal to that of the body portion.

Optionally, in some embodiments the first axis is orthogonal to the base.

Optionally, in some embodiments the dispensing head has an exterior periphery which is less than that of the neck portion.

Optionally, in some embodiments the dispensing head has an exterior periphery which is greater than that of the neck portion.

Optionally, in some embodiments at each of front and rear surfaces of the container, the neck portion and the body portion are connected by a continuously curved intersection.

Optionally, in some embodiments at each of front and rear surfaces of the container, the neck portion and the body portion are connected by a bend in the container.

Optionally, in some embodiments the cross-sectional area of the container at the neck portion is less than that at the base.

Optionally, in some embodiments the cross-sectional area of the container at the head portion is less than that at the base.

Optionally, in some embodiments the cross-sectional area of the container progressively decreases from the base to a bottom of the head portion.

Optionally, in some embodiments the cross-sectional area of the container at the neck portion is greater than that at the base.

Optionally, in some embodiments the cross-sectional area of the container at the head portion is greater than that at the base.

Optionally, in some embodiments the cross-sectional area of the container progressively increases from the base to a bottom of the head portion.

Optionally, in some embodiments the second axis is inclined to the first axis at an acute angle of from 5° to 40°, further optionally from 10° to 30°.

Optionally, in some embodiments the cap has an exterior side surface which mates with the adjacent surface of the neck portion so that the exterior surfaces of the container and cap are smoothly continuous at a parting line therebetween.

The present invention further provides a package for a composition, the package comprising a container containing a composition, the container having a base comprising a base face for standing the package on a horizontal planar surface in an upright orientation at a first angle to the vertical, and a cap removably connected to and covering a dispensing end of the container opposite to the base, wherein the cap has an end face which is inclined to the base face for standing the package on a planar surface in an inverted orientation at a second angle to the vertical.

Optionally, in some embodiments in the upright orientation the centre of gravity of the package lies within the area of the base face and in the inverted orientation the centre of gravity of the package lies within the area of the end face.

Optionally, in some embodiments the container and cap are shaped to permit the package, independent of the amount of the consumer composition contained within the container, selectively to be stood in the upright orientation or in the inverted orientation on the planar surface.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

The following description of the preferred embodiment(s) is merely exemplary in nature and is in no way intended to limit the invention, its application, or uses.

It should be understood that the detailed description and specific examples, while indicating embodiments of the invention, are intended for purposes of illustration only and are not intended to limit the scope of the invention.

The following definitions and non-limiting guidelines must be considered in reviewing the description of this invention set forth herein. The headings (such as "Background Of The Invention" and "Summary Of The Invention,") used herein are intended only for general organization of topics within the disclosure of the invention, and are not intended to limit the disclosure of the invention or any aspect thereof. In particular, subject matter disclosed in the "Background Of The Invention" may include aspects of technology within the scope of the invention, and may not constitute a recitation of prior art. Subject matter disclosed in the "Summary Of The Invention" is not an exhaustive or complete disclosure of the entire scope of the invention or any embodiments thereof.

The citation of references herein does not constitute an admission that those references are prior art or have any relevance to the patentability of the invention disclosed herein. Any discussion of the content of references cited in the Background of the Invention is intended merely to provide a general summary of assertions made by the authors of the references, and does not constitute an admission as to the accuracy of the content of such references. Each and every reference cited herein is hereby incorporated by reference in its entirety.

The detailed description, while indicating embodiments of the invention, is intended for purposes of illustration only and is not intended to limit the scope of the invention. Moreover, recitation of multiple embodiments having stated features is not intended to exclude other embodiments having additional features, or other embodiments incorporating different combinations the stated of features.

As used herein, the words "preferred" and "preferably" refer to embodiments of the invention that afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the word "include," and its variants, is intended to be non-limiting, such that recitation of items in a list is not to the exclusion of other like items that may also be useful in the dispensers of this invention.

Figure 1:
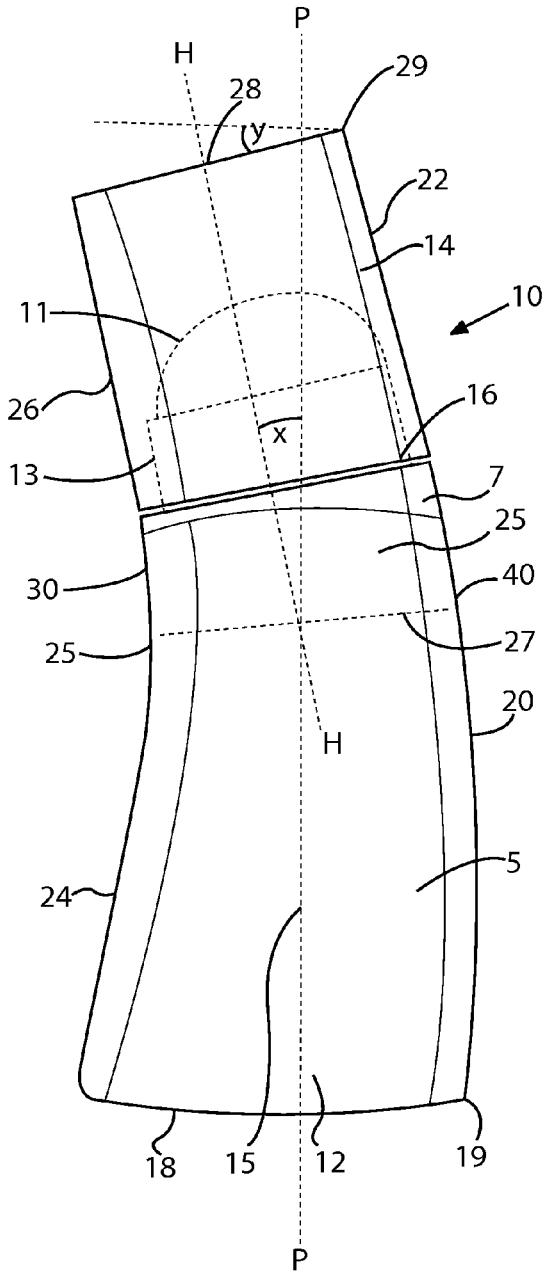
FIG. 1 schematically illustrates a side view of a package for a consumer composition in accordance with a first embodiment of the present invention.
Figure 2:
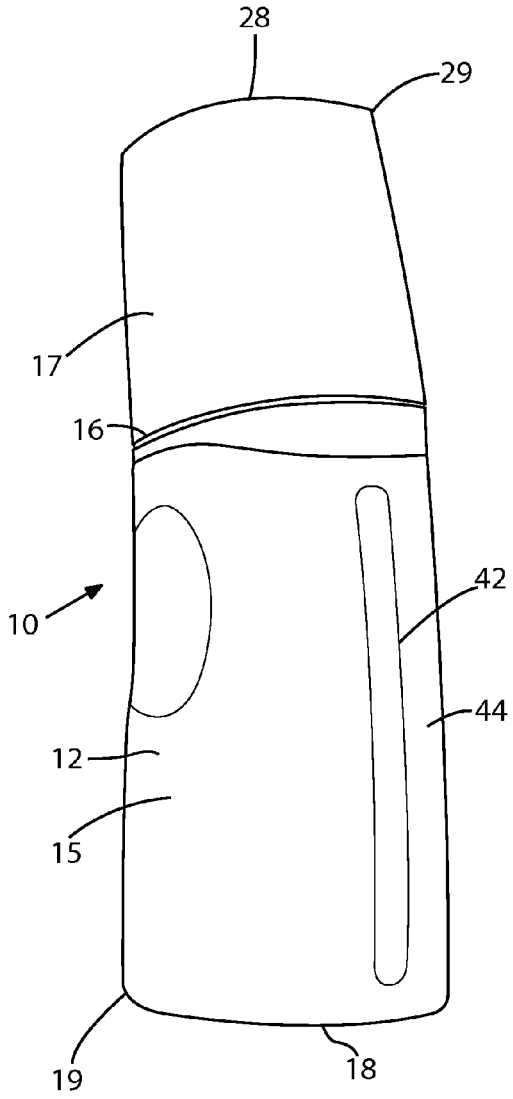
FIG. 2 schematically illustrates a perspective view, from the rear and one side, of the package of FIG. 1.

FIG. 1 schematically illustrates a side view of a package, designated generally as 10, for a consumer composition in accordance with a first embodiment of the present invention. FIG. 2 schematically illustrates a perspective view, from the rear and one side, of the package 10 of FIG. 1.

Referring in detail to FIGS. 1 and 2, the package 10 is a roll-ball dispenser for a consumer composition such as an antiperspirant composition, a deodorant composition, a detergent composition and/or a softener composition. A container in the form of a bottle 12 contains the liquid consumer composition and a roll-ball 11 (shown in phantom in FIG. 1) is held captive at a dispensing head 13 at the top of the bottle 12. The roll-ball 11 is covered by a removable cap 14 when the product is not in use. The cap 14 is typically removably connected to the bottle 12 by a threaded or snap-fit connection, there being a parting line 16 at the junction between the lower edge of the cap 14 and the upper edge of the bottle 12.

The bottle 12 has a substantially planar base 18. The dispensing head 13 is located above a neck portion 7 which extends from a body portion 5 located above the base 18. A rear wall 20 extends upwardly from the base 18 and has a smoothly convex exterior surface with substantially continuous curvature. A front wall 24 extends upwardly from the base 18 and the exterior surface has a lower substantially planar portion 24 connected to an upper concave portion 25. The front wall 24 and rear wall 20 are asymmetrical, to provide an inclined head 13 which is oriented dispensing head 13 which is oriented upwardly and towards the front wall 24. The bottle 12 is ergonomically shaped and dimensioned so that when the bottle 12 is grasped in the hand the thumb of the user can rest against the upper concave portion 25 of the front wall 24 and the fingers of the user can rest against the rear wall 20. The opposite side-walls 15 of the bottle 12 may be planar on non-planar and parallel or inclined. In the illustrated embodiment the side-walls 15 are upright, substantially planar and substantially parallel.

The cap 14 correspondingly has a rear wall 22 and a front wall 26 which mate respectively with the rear wall 20 and the front wall 24 of the bottle 12 when the cap 14 is closed, so that the combination of the bottle 12 and cap 13 has substantially continuous rear and front surfaces 40, 30. The cap 14 also has side-walls 17 which correspondingly mate with the side-walls 15 of the bottle 12. This provides a unitary design for the bottle 12 and cap 14, so that in the closed configuration the one is a continuation of the other, and the outer surfaces of the bottle 12 and cap 14 are smoothly continuous at the parting line 16.

The cap 14 also has a top wall 28, which is substantially planar. The top wall 28 is inclined to the substantially planar base 18 of the bottle 12. Accordingly, when the bottle 12 is stood on the base 18, the top wall 28 of the cap 14 is inclined at an angle to the base 18, and consequently to the surface on which the package 10 is standing.

Typically, the top wall 28 of the cap 14 is inclined at an acute angle y, typically from 5° to 40°, more typically from 15° to 35°, to the planar base 18 of the bottle 12. The angle selected may be varied dependent upon the dimensions of the bottle 12 and cap 14, and in particular on the dimensions of the base 18 and the top wall 28, to provide that in either standing orientation, upright or inverted, the centre of gravity of the package 10 lies within the exterior periphery of the respective standing surface so that the package 10 is stable independent of the fill level of any consumer composition within the package 10. For each of the other embodiments, a similar angular relationship between the base and the top wall may be provided.

As is conventional, the substantially planar base 18 of the bottle 12 has a peripheral edge 19 which has both shape and dimensions so that irrespective of the fill level of the liquid product within the bottle 12, when the bottle 12 is upright and standing on the base 18 the centre of gravity of the bottle 12, with or without the cap 14, lies within the area defined by the peripheral edge 19. This ensures that the package can stand upright in a stable manner, without tipping over, throughout the lifetime of the product within the package 10.

As described above, the inclined dispensing head 13 is oriented laterally towards the front of the bottle 12. The dispensing head 13 is oriented along a head axis H-H which is inclined at an acute angle x, typically from 5° to 40°, more typically from 10° to 30°, to the primary axis P-P of the bottle 12, the latter being orthogonal to the base 18.

Such an angled orientation for the roll-ball head 13 provides a directional orientation for the roll-ball 11, so that the skin-contacting face of the roll-ball 11 points away from the primary axis P-P.

The upper neck portion 7 of the bottle 12 upon which the dispensing head 13 is disposed, and which is inclined along the axis H-H, has external dimensions which are substantially the same as or less than those of the lower body portion 5 of the bottle 12 which is aligned along the axis P-P. The neck portion 7 and body portion 5 are connected at a curved intersection 27 in the bottle 12, so that the neck portion 7 extends in an angled orientation away from the body portion 5 to be held by the hand. The ball diameter is selected so that the roll-ball 11 and the head 13 therefor have external dimensions which are less than those of the neck portion 7 of the bottle 12. This provides a slender neck structure 25 for the package 10 in that the cross-sectional area of the package 10 does not increase at the neck portion 7 or dispensing head 13 as compared to the body portion 5 or base 18.

Such a directional orientation of the roll-ball 11 on a slender neck structure 25 provides a roll-ball package 10 which can exhibit improved manual control for achieving targeted application of the liquid anti-perspirant/deodorant product to desired surfaces of the skin, the inclined roll-ball on the extending neck providing clearance of the fingers and the body of the package 10 to avoid unintended contact with the skin in the vicinity of the underarm.

Such an angled bottle 12 also provides the advantage that the bottle 12 requires a reduced degree of tilt or inversion of the bottle 12 to provide an initial wetting of the interior surface of the roll-ball 11 facing the interior of the bottle 12 which contains the liquid anti-perspirant/deodorant product.

The angled bottle shape also provides a distinctive aesthetic front view for visual impact of the package in a retail environment. The combination of the bottle 12 and cap 14 has substantially continuous rear and front surfaces 40, 30. The angle of the roll-ball head 14 is emphasised by the corresponding angle of the cap 14.

In accordance with this embodiment of the invention, the top wall 28 of the cap also has a peripheral edge 29 which has both shape and dimensions so that, irrespective of the fill level of the liquid product within the bottle 12, when the bottle 12 is inverted and standing on the cap 14 the centre of gravity of the bottle 12 lies within the area defined by the peripheral edge 29.

Accordingly, when the cap 14 is fitted to bottle 12, the package 10 may be selectively stood upright either on its bottle end or on its cap end.

This selective orientation of the package 10 provides a number of technical advantages.

First, the package 10 can be shipped to retail outlets and merchandised to the consumer in a "ball-up" orientation, with the package 10 stood upright on the base 18 of the bottle 10. This provides that leakage of liquid product from the bottle 12, such leakage potentially occurring around the seal between the head 13 and the roll-ball 11, is minimized. However, the user can readily store the package 10 in an inverted orientation on the top wall 28 of the cap 14. This provides that the roll-ball 11 is maintained wet with the liquid product and ready to apply to the skin of the user. The user can alternatively, as desired, store the package 10 in an upright orientation on base 18 of the bottle 10. Then, when the bottle 12 is nearly empty of the liquid product, the package 10 may be inverted, and subsequently stored in such an inverted orientation, in order to maximize use-up of the product until the entire product within the bottle 12 is fully exhausted.

Yet further, such an asymmetrical and invertible package structure creates an aesthetically pleasing and distinctive package. The package not only provides shelf impact and disruption which is perceived by the consumer, but also provides a distinctive package shape in the home. The top wall of the cap and the base of the bottle are mutually inclined, and coupled with the structural and visual asymmetry of the front and rear walls of the package, it is not immediately apparent to the consumer that the package can be stably stood, without inadvertent tipping over, either on the base or on the cap, as desired. The package can be presented to the consumer in an upright orientation, and then the consumer can subsequently discover that the package can be stably stored in an inverted orientation. This can surprise and delight the consumer, and also, as explained above, provide technical advantages not only during shipping and merchandising but also during use by the consumer.

As shown in FIG. 2, the rear wall 20 is provided with a window 42 surrounded by a peripheral portion 44 of the rear wall 20. The window 42 is elongate and oriented in an upright configuration. The window 42 is transparent or translucent, and is adapted, together with the selected product within the bottle 12, to ensure that the product fill level within the bottle 12 can be seen through the window 42 by the user. Such an elongate window spanning at least a major portion of, or even the entire, initial product fill level within the bottle 10, permits the liquid level within the bottle to be visible to the user for an extended portion of the product life.

Figure 3:
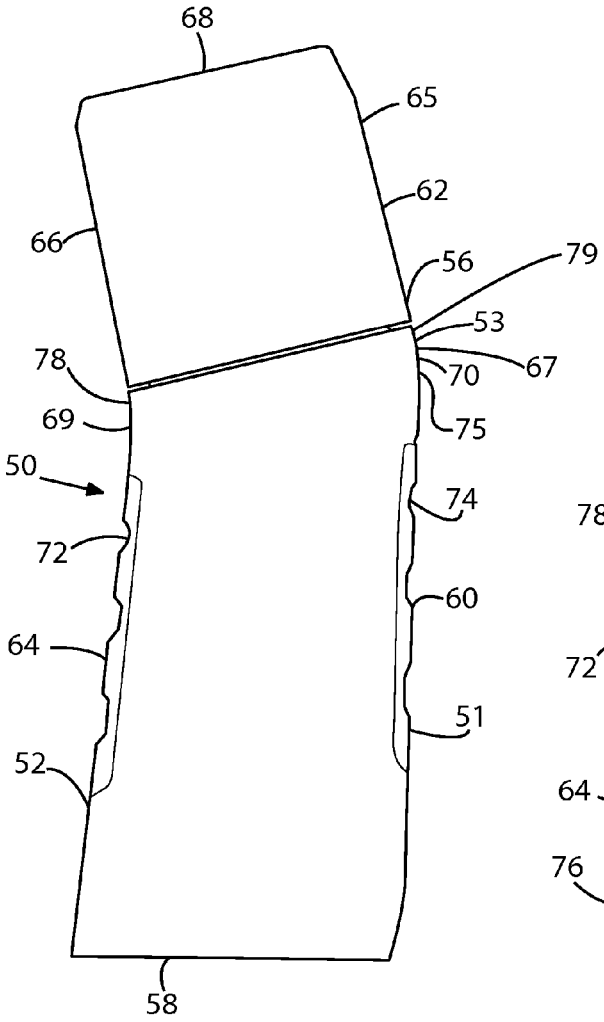
FIG. 3 schematically illustrates a side view of a package for a consumer composition in accordance with a second embodiment of the present invention.
Figure 4:
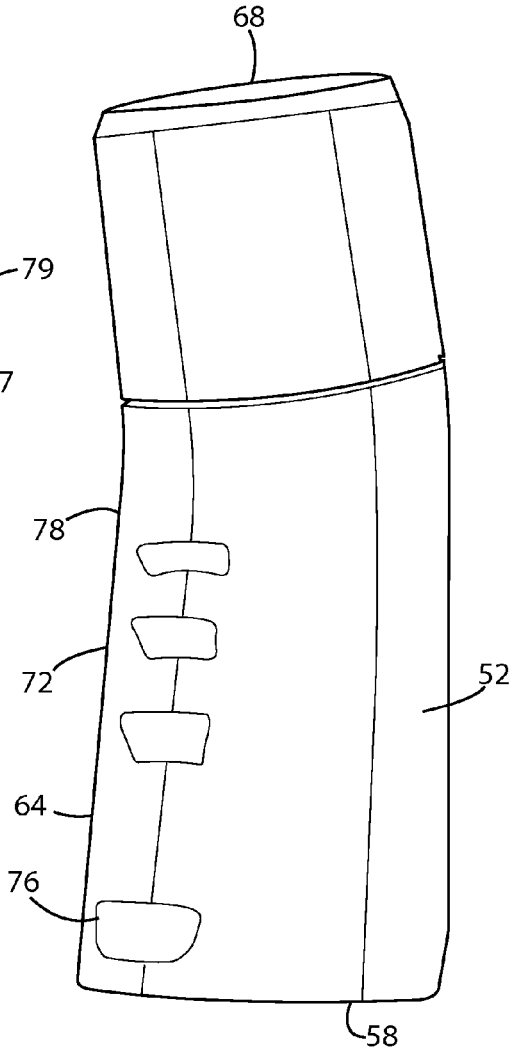
FIG. 4 schematically illustrates a perspective view, from the front and one side, of the package of FIG. 3.

FIGS. 3 and 4 illustrate a package, designated generally as 50, for a consumer composition in accordance with a second embodiment of the present invention. This embodiment is similar to the first embodiment except that the front and rear walls of the bottle have a different shape and configuration and the window is located at a different location on the bottle.

Again, as for the first embodiment, the package 50 is a roll-ball dispenser for a consumer composition such as an antiperspirant composition and/or a deodorant composition. A bottle 52 contains the liquid consumer composition and a roll-ball (not shown) is held captive at a dispensing head (not shown) at the top of the bottle 52, the dispensing head being mounted on an angled neck portion 53. The roll-ball is covered by a removable cap 62 when the product is not in use. A parting line 56 is at the junction between the lower edge of the cap 62 and the upper edge of the bottle 52.

The bottle 52 has a substantially planar base 58. A rear wall 60 extends upwardly from the base 58 and is substantially planar except at a rear intersection 70 with the neck portion 53 at which the rear wall 60 inclines forwardly. A front wall 64 extends upwardly from the base 58 and is substantially planar except at a front intersection 69 at which the front wall 64 inclines forwardly to form the neck portion 53. The front intersection 69 and rear intersection 70 comprise the connection between the neck portion 53 and the lower body portion 51. The substantially planar portions of the front wall 64 and rear wall 60 are mutually inclined, in a converging manner in a direction upwardly away from the base 58, and are asymmetrical, to provide an inclined neck portion 53 which is oriented upwardly and towards the front wall 64.

The front wall 64 and rear wall 60 are respectively provided with a series of horizontally oriented inwardly moulded linear indents 72, 74 to assist gripping of the package 50 by the hands of the user, particularly when the package and/or hands are wet.

As described above, the inclined head and neck portion 53 are oriented towards the front wall 64. Again, the head and neck portion 53 are oriented along a head axis which is inclined at an acute angle to the primary axis of the bottle, the latter being orthogonal to the base 58.

Such an angled orientation for the roll-ball head and neck portion 53 provides a directional orientation for the roll-ball, so that the skin-contacting face of the roll-ball points away from the primary axis.

The neck portion 53 of the bottle 52 upon which the head is disposed, and which is inclined along the head axis, has external dimensions which may be substantially the same as or less than those of the body portion 51 of the bottle 52 which is aligned along the primary axis. The upper neck portion 53 and lower body portion 51 are connected at a bend 67 in the bottle 52, so that the neck portion 53 extends in an angled orientation away from the body portion 51 to be held by the hand. Again, the ball diameter is selected so that the roll-ball and the head therefor have external dimensions which are less than those of the neck portion 53 of the bottle 52. This provides a slender neck structure 75 for the package 50 in that the cross-sectional area of the package 50 does not increase at the head or neck portion 53 as compared to the base 58. In some embodiments, however, the ball diameter is selected so that the roll-ball and the head therefor have external dimensions which are greater than those of the neck portion 53 of the bottle 52. The cross-sectional area of the package 50 increases at the head or neck portion 53 as compared to the base 58.

The cap 62 has a rear wall 65 and a front wall 66 which mate respectively with the upper ends 79, 78 of the rear wall 60 and the front wall 64 of the bottle 12 when the cap 62 is closed.

The cap 62 also has a top wall 68, which is substantially planar. The top wall 68 is inclined to the substantially planar base 58 of the bottle 52. Accordingly, as for the first embodiment, when the bottle 52 is stood on the base 58, the top wall 68 of the cap 62 is inclined at an angle to the base 58, and consequently to the surface on which the package 50 is standing.

Again, when the cap 62 is fitted to bottle 52, the package 50 may be selectively stood upright either on its bottle end or on its cap end.

As shown in FIG. 4, the front wall 64 is provided with a window 76 located slightly above the base 58. Again, the window 76 is transparent or translucent, and is adapted, together with the selected product within the bottle 52, to ensure that the product fill level within the bottle 52 can be seen through the window 76 by the user. Such a window 76 at the bottom of the bottle 52 near the base 58 provides that when the bottle is oriented "ball-up", the product fill level is visible to the user when the product within the bottle 52 is almost exhausted. The user would then know to invert the package in order to be able to use up the last remaining amount of the liquid product within the package.

In a modification of this embodiment, a window may be located at the ball-end of the bottle, either as an additional window to the window at the base or as an alternative window to the window at the base. Such a window location provides that when the when the bottle is oriented "ball-down" in an inverted orientation, the product fill level is visible to the user when the product within the bottle is almost exhausted. The user would then know that the package was nearly exhausted and required imminent replacement.

Figure 5:
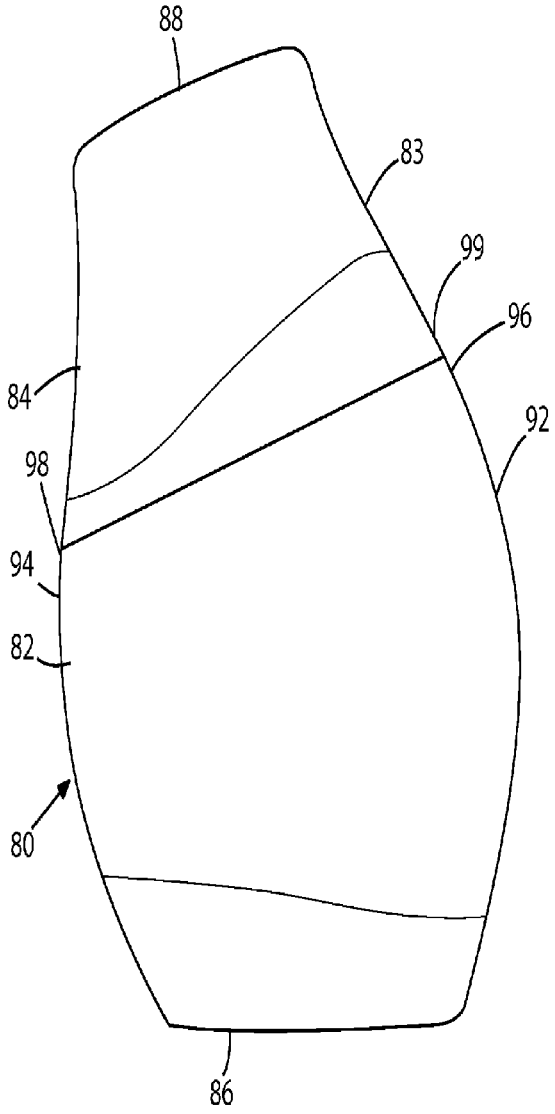
FIG. 5 schematically illustrates a side view of a package for a consumer composition in accordance with a third embodiment of the present invention.
Figure 6:
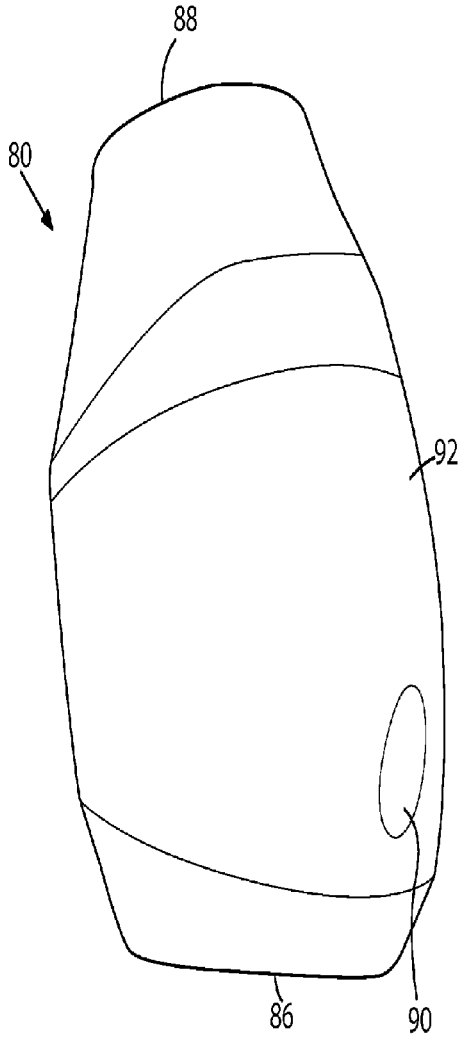
FIG. 6 schematically illustrates a perspective view, from the rear and one side, of the package of FIG. 5.

FIGS. 5 and 6 illustrate a package, designated generally as 80, for a consumer composition in accordance with a third embodiment of the present invention. This embodiment is similar to the second embodiment except that the shape and configuration of the bottle and cap are different.

Again, as for the first and second embodiments, the package 80 is a roll-ball dispenser for a consumer composition such as an antiperspirant composition and/or a deodorant composition. A bottle 82 contains the liquid consumer composition and a roll-ball (not shown) is held captive at a dispensing head at the top of the bottle 82. The roll-ball is covered by a removable cap 84 when the product is not in use. The exterior The bottle 82 has a substantially planar base 86. The bottle 82 has a more rounded shape than the previous embodiments. An arcuate convex rear wall 92 and an arcuate convex front wall 94 each extends upwardly from the base 86. The upper end 96 of the rear wall 92 is higher than the upper end 98 of the front wall 94 and so a parting line 99 between the bottle 82 and the cap 84 inclines forwardly. The exterior surfaces of the bottle 82 and side 83 of the cap 84 mate at the parting line 99 to provide a smoothly continuous exterior surface for the package 80.

The cap 84 has a top wall 88, which is substantially planar and inclined to the substantially planar base 86 of the bottle 82. Accordingly, as for the previous embodiments, when the bottle 82 is stood on the base 86, the top wall 88 of the cap 84 is inclined at an angle to the base 86, and consequently to the surface on which the package 80 is standing.

Again, when the cap 84 is fitted to bottle 82, the package 80 may be selectively stood upright either on its bottle end or on its cap end.

As shown in FIG. 6, the rear wall 92 is provided with a window 90 located in the vicinity of the base 86. Again, the window 90 is transparent or translucent, and is adapted, together with the selected product within the bottle 82, to ensure that the product fill level within the bottle 82 can be seen through the window 90 by the user. Such a window 90 at the bottom of the bottle 82 near the base 86 provides that when the bottle 82 is oriented "ball-up", the product fill level is visible to the user when the product within the bottle 82 is almost exhausted.

Again, in a modification of this embodiment, a window may be located at the ball-end of the bottle, either as an additional window to the window at the base or as an alternative window to the window at the base.

Figure 7:
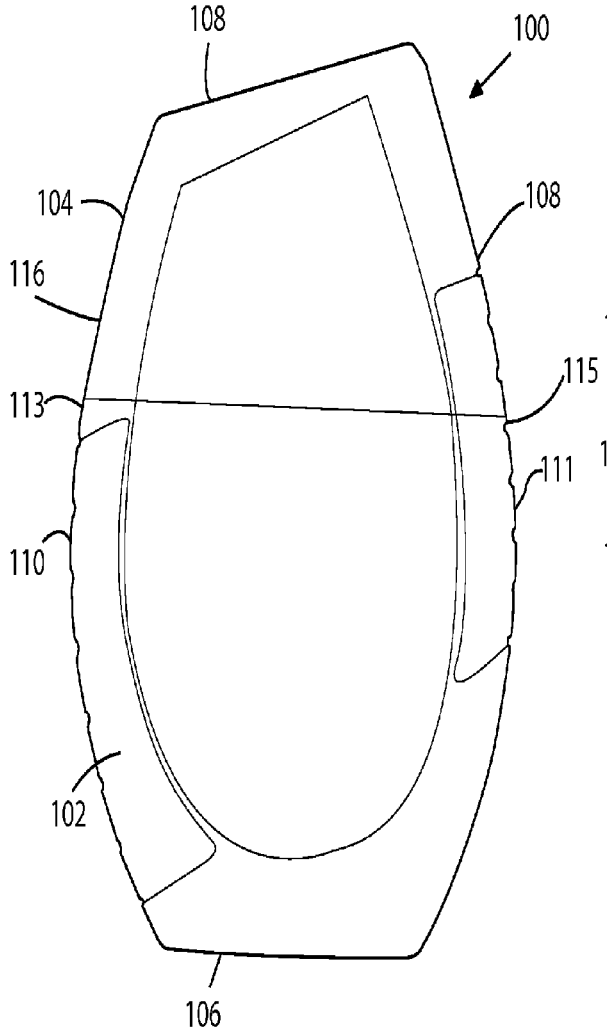
FIG. 7 schematically illustrates a side view of a package for a consumer composition in accordance with a fourth embodiment of the present invention.
Figure 8:
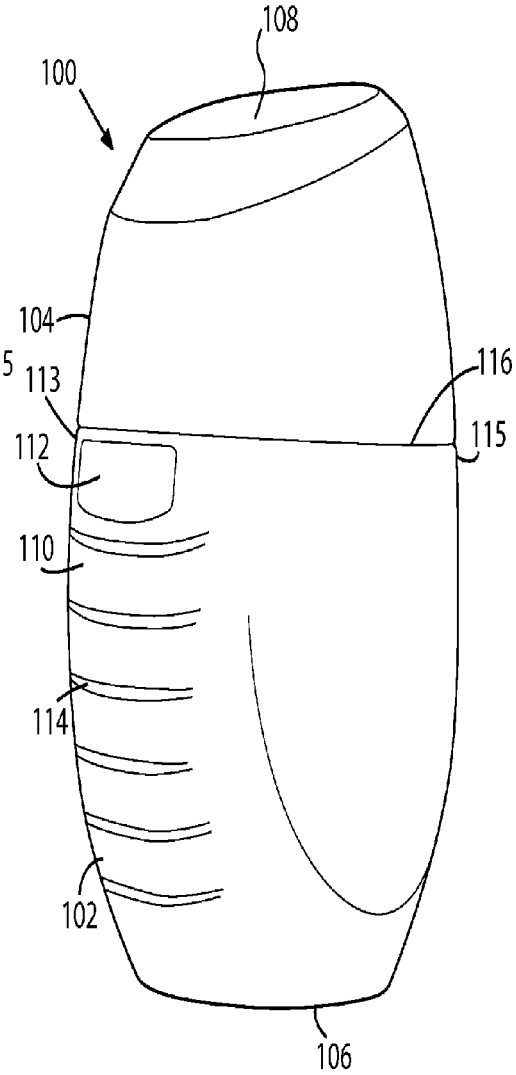
FIG. 8 schematically illustrates a perspective view, from the front and one side, of the package of FIG. 7.
Figure 9:
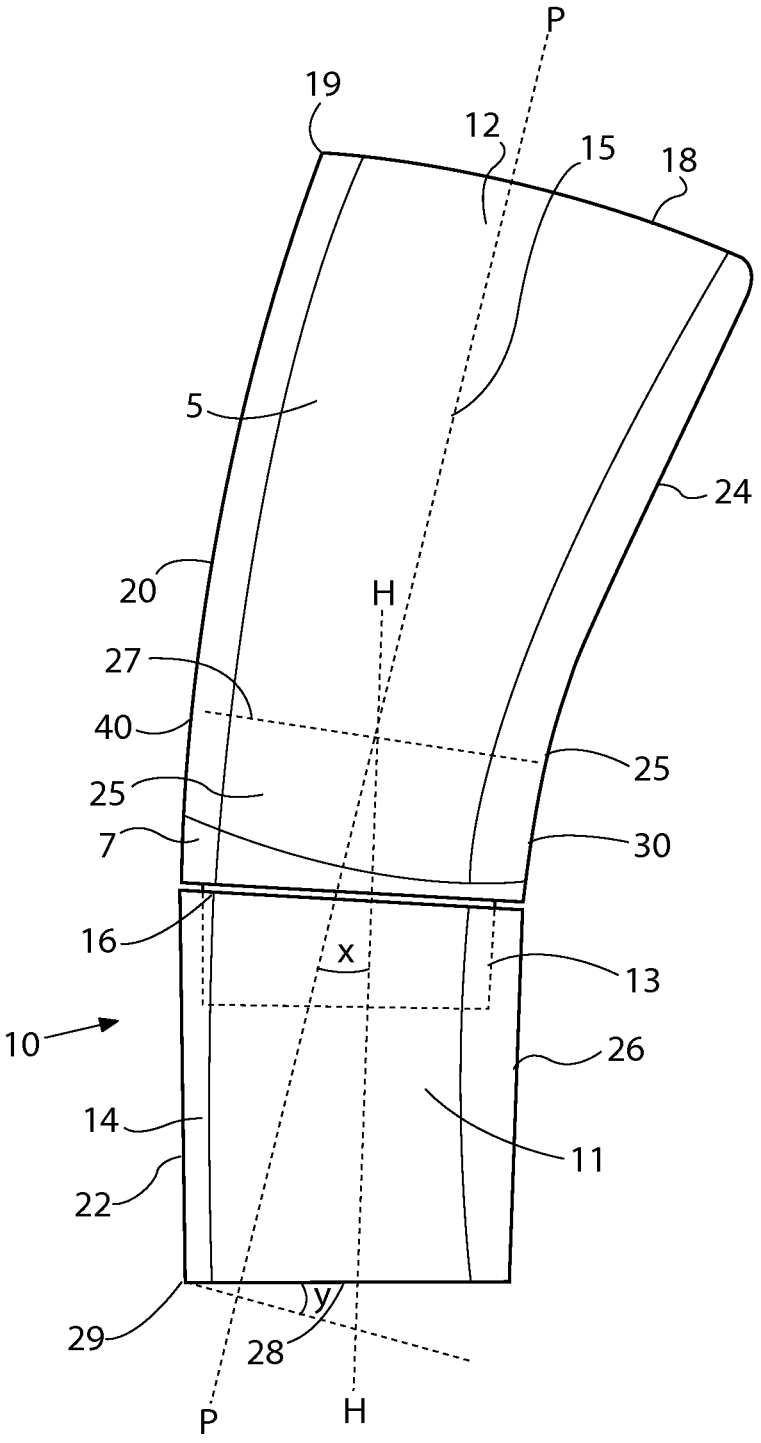
FIG. 9 schematically illustrates an exemplary container standing on its end face in an inverted orientation.

FIGS. 7 and 8 illustrate a package, designated generally as 100, for a consumer composition in accordance with a fourth embodiment of the present invention. In this embodiment, the shape and configuration of the bottle and cap are different and unlike the previous embodiments, the sides of the bottle and cap are substantially symmetric, and a window is located at the top of the bottle.

Again, as for the previous embodiments, the package 100 is a roll-ball dispenser for a consumer composition such as an antiperspirant composition and/or a deodorant composition. A bottle 102 contains the liquid consumer composition and a roll-ball (not shown) is held captive at a dispensing head at the top of the bottle 102. The roll-ball is covered by a removable cap 104 when the product is not in use.

The bottle 102 has a substantially planar base 106. The bottle 102 has a more rounded shape than the first and second embodiments, and a more symmetric shape than the previous embodiments. An arcuate convex front wall 110 and an arcuate convex rear wall 111 each extends upwardly from the base 106. The upper end 113 of the front wall 110 is at the same height as the upper end 115 of the rear wall 111 and so a parting line 116 between the bottle 102 and the cap 104 is parallel to the base 106. The exterior surfaces of the bottle 102 and side 103 of the cap 104 mate at the parting line 116 to provide a smoothly continuous exterior surface for the package 100.

The cap 104 has a top wall 108, which is substantially planar and inclined to the substantially planar base 106 of the bottle 102. Accordingly, as for the previous embodiments, when the bottle 102 is stood on the base 106, the top wall 108 of the cap 104 is inclined at an angle to the base 106, and consequently to the surface on which the package 100 is standing.

Again, when the cap 104 is fitted to bottle 102, the package 100 may be selectively stood upright either on its bottle end or on its cap end.

The roll-ball, concealed by the cap 104, may be inclined relative to the base 106 so as to have an inclination similar to that of the top wall 108 of the cap 104. Alternatively the roll-ball, concealed by the cap 104, may be parallel with the base 106.

As shown in FIG. 8, the front wall 110 is provided with a window 112 located in the vicinity of the upper end 113 of the front wall 110. Again, the window 112 is transparent or translucent, and is adapted, together with the selected product within the bottle 102, to ensure that the product fill level within the bottle 102 can be seen through the window 112 by the user. Such a window 112 at the top of the bottle 102 provides that when the bottle 102 is oriented "ball-down", the product fill level is visible to the user when the product within the bottle 102 is almost exhausted.

Again, in a modification of this embodiment, a window may be located at the base of the bottle, either as an additional window to the window at the ball-end or as an alternative window to the window at the ball-end.

Various other modifications to the disclosed embodiments will be apparent to those skilled in the art. In particular, alternative embodiments having a cap fitted to a container so that the package may be selectively stood upright either on its container end or on its cap end may comprise stick dispensers, for dispensing a solid stick of a consumer composition such as an antiperspirant composition and/or a deodorant composition, rather than roll-ball dispensers.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

What is claimed is:

1. A package for a composition, the package comprising a container, the container having a base comprising a base face for standing the package on a planar surface, and a cap removably connected to and covering a dispensing end of the container opposite to the base, wherein the cap has an end face which is inclined to the base face, and wherein the container and cap are shaped to permit the package, independent of the amount of a composition contained within the container, selectively to be stood on the base face in an upright orientation on the planar surface or on the end face in an inverted orientation on the planar surface, wherein when the package is stood in an upright orientation the centre of gravity of the package lies within the area of the base face, and when the package is stood in an inverted orientation the centre of gravity of the package lies within the area of the end face.

2. The package according to claim 1 wherein the package is a roll-ball dispenser for a liquid composition and the dispensing head includes a roll-ball captive in the head.

3. The package according to claim 1 wherein the composition is an antiperspirant composition and/or a deodorant composition.

4. The package according to claim 1 wherein the end face and the base face are mutually inclined at an acute angle of from 5° to 40°.

5. The package according to claim 4 wherein the end face and the base face are mutually inclined at an acute angle of from 15° to 35°.

6. The package according to claim 1 wherein the container includes at least one window to permit a user to see the composition within the container.

7. The package according to claim 6 wherein the at least one window is located in the vicinity of the base face.

8. The package according to claim 6 wherein the at least one window is located in the vicinity of the dispensing end.

9. The package according to claim 6 wherein the at least one window comprises a first window located in the vicinity of the base face and a second window located in the vicinity of the dispensing end.

10. The package according to claim 6 wherein the at least one window comprises an elongate window extending longitudinally from the vicinity of the base face to the vicinity of the dispensing end.

11. The package according to claim 1 wherein the container has a body portion above the base, a neck portion above the body portion, and a dispensing head above the neck portion, the cap covering the dispensing head, the body portion being aligned along a first axis and the neck portion being aligned along a second axis which is inclined to the first axis so that the dispensing head is directed upwardly and laterally towards a front of the container, the neck portion and the dispensing head having an exterior periphery which is not equal to that of the body portion.

12. The package according to claim 11 wherein the first axis is orthogonal to the base.

13. The package according to claim 11 wherein the dispensing head has an exterior periphery which is less than that of the neck portion.

14. The package according to claim 11 wherein at each of front and rear surfaces of the container, the neck portion and the body portion are connected by a continuously curved intersection.

15. The package according to claim 11 wherein at each of front and rear surfaces of the container, the neck portion and the body portion are connected by a bend in the container.

16. The package according to claim 11 wherein the cross-sectional area of the container at the neck portion is less than that at the base.

17. The package according to claim 11 wherein the cross-sectional area of the container at the head portion is less than that at the base.

18. The package according to claim 11 wherein the cross-sectional area of the container progressively decreases from the base to a bottom of the head portion.

19. The package according to claim 11 wherein the second axis is inclined to the first axis at an acute angle of from 5° to 40°.

20. The package according to claim 19 wherein the second axis is inclined to the first axis at an acute angle of from 10° to 30°.

21. The package according to claim 11 wherein the cap has an exterior side surface which mates with the adjacent surface of the neck portion so that the exterior surfaces of the container and cap are smoothly continuous at a parting line therebetween.

22. A package for a composition, the package comprising a container, the container having a base comprising a base face for standing the package on a horizontal planar surface in an upright orientation at a first angle to the vertical, and a cap removably connected to and covering a dispensing end of the container opposite to the base, wherein the cap has an end face which is inclined to the base face for standing the package on a planar surface in an inverted orientation at a second angle to the vertical, wherein in the upright orientation the centre of gravity of the package lies within the area of the base face and in the inverted orientation the centre of gravity of the package lies within the area of the end face.

23. The package according to claim 22 wherein the container and cap are shaped to permit the package, independent of the amount of the composition contained within the container, selectively to be stood in the upright orientation or in the inverted orientation on the planar surface.

24. The package according to claim 22 wherein the package is a roll-ball dispenser for a liquid consumer composition and the dispensing head includes a roll-ball captive in the head.

25. The package according to claim 22 wherein the composition is an antiperspirant composition and/or a deodorant composition.

26. The package according to claim 22 wherein the end face and the base face are mutually inclined at an acute angle of from 5° to 40°.

27. The package according to claim 26 wherein the end face and the base face are mutually inclined at an acute angle of from 15° to 35°.

28. The package according to claim 22 wherein the cap has an exterior side surface which mates with the adjacent surface of the container so that the exterior surfaces of the container and cap are smoothly continuous at a parting line therebetween.

* * * * *